US006499593B1

(12) United States Patent
Uner et al.

(10) Patent No.: US 6,499,593 B1
(45) Date of Patent: Dec. 31, 2002

(54) GOLF BAG

(75) Inventors: Randy Uner, Mound, MN (US); Don Schuneman, Witchita, KS (US)

(73) Assignee: Hakker Golf Bag, Inc., Mound, MN (US)

( * ) Notice: Subject to any disclaimer, the term of this patent is extended or adjusted under 35 U.S.C. 154(b) by 68 days.

(21) Appl. No.: 09/695,524

(22) Filed: Oct. 24, 2000

(51) Int. Cl.[7] ..... A63B 55/00
(52) U.S. Cl. ..... 206/315.3; 211/70.2
(58) Field of Search ..... 206/315.3, 315.2, 206/315.5; 190/108; 224/911; 150/159, 160; 211/70.2

(56) References Cited

U.S. PATENT DOCUMENTS

| | | | | | |
|---|---|---|---|---|---|
| 2,502,627 | A | * | 4/1950 | Martin | 206/315.3 |
| 3,842,876 | A | * | 10/1974 | Cristelli | 206/315.4 |
| 4,655,346 | A | * | 4/1987 | Reinholz | 206/315.6 |
| 5,465,839 | A | * | 11/1995 | Gretz | 206/315.3 |
| 5,472,084 | A | | 12/1995 | Aliano, Jr. | 206/315.3 |

FOREIGN PATENT DOCUMENTS

| | | | | |
|---|---|---|---|---|
| DE | WO 91/18650 | * | 12/1991 | 206/315.3 |

OTHER PUBLICATIONS

Photos of bag purchased by Applicant on May 30, 2001 with Accompanying CD containing photos.
PGA Reviews by Steve Pile.
Press Release, "Piggy Back Gold Bag Provides Golfers with Solution for Slow Play" (No date).
Press Release, True Life Rocky Theme Unfolds with Launch of Piggy Back Golf Bag—Philadelphia, PA Nov. 6, 2000.
Press Release, "Joseph Aliano FTN" (No date).
Press Release, Classic Finish Golf Sign Exclusive Agreement Martin's Golf & Tennis Shop—Philadelphia, PA Sep. 8, 2000.
Article, New Gold Accessories for 2000, Golf Illustrated—by: Laurie Lee Dovey, Equipment Editor (No date).
Article, Bag technology that can help make the game better—by: Seth Fox (No date).
Article, Golf isn't NASCAR, but speed counts, too Speed Counts, Golf Guide; Community News, Del Apr., 2001—by Reid Champangne.
Article, Ready for "Ready Golf"—Florida Golf Central; Nov. 2000—by: Carlton Vinson.
Article, Piggy Back Golf Bag, The Times Herald—Feb. 5, 2001.
Article, Locals Display wares at PGA Show, Daily Local News, Feb. 8, 2001—by: Reid Champagne.
Article, Christmas Gift Ideas for the Golfer on Your List, Sun Herals—by: Grant Boxleitner (No date).
Article, The Good Stuff, People, Places and Things, Chicago Golf Magazine—by: Bill Daniels (No date).
Article, Piggy Back Golf Bag, PGA Tour Partner's Magazine, Jul./Aug. 2000.
6 pg Piggy Back Golf Bag Brochure, date unknown.

* cited by examiner

*Primary Examiner*—Stephen P. Garbe
*Assistant Examiner*—Lien Ngo
(74) *Attorney, Agent, or Firm*—Vidas, Arrett & Steinkraus P.A.

(57) ABSTRACT

A full-sized golf bag of variable configuration having a detachable smaller golf bag that may be used to carry a small number of clubs to a remote chosen location.

18 Claims, 3 Drawing Sheets

GOLF BAG

BACKGROUND OF THE INVENTION

The present invention relates to golf bags. Conventionally, bags of this type are constituted by rigid and/or semi-rigid containers which are fairly voluminous and are provided with club-carrying compartments, as well as with further integral accessory-carrying compartments or pockets. These bags may either be carried by a golfer or they may be attached to a pull cart or a golf cart. In many instances the bags are not suitable for carrying on the shoulder due to their bulk and weight. Furthermore, these bags in many instances have irregular shapes, often with bulky bulging portions, and are thus inconvenient in use and difficult to place when not in use. The present invention is directed to relieving problems and inconveniences that may arise with an overly heavy and bulky golf bag.

One particular problem that arises is the situation a golfer finds himself in when the players ball is in a lie unseen from the players cart. Many times golf courses have designated areas which are off limits to golf carts, and sometimes physically unreachable in the golf cart. This is may be the case when golf courses require that the carts stay on a designated path. A golfers ball may be on the opposite side of the fairway. Similarly, access to a position in close proximity to the greens is almost always restricted. It is in these situations that the golfer must investigate his lie prior to choosing his club. Many times a golfer will take a number of clubs from his bag and carry them to his ball. This can be an inconvenient situation because the golfer may have to carry many clubs as the position and lie of the ball can markedly alter ones club selection. Still further, carrying a number of loose clubs to ones ball, as every golfer knows, may result in a lost club by overlooking one or two of the clubs which are not used for the shot when the golfer returns to his cart.

The present invention allows for all the advantages of a conventional golf bag in addition to a small detachable carrying bag. With the present invention, the golfer will be able to secure the golf bag to a carrying device, such as a golf cart, and easily detach a small portion of the bag to carry a small number of clubs to a remote site on the golf course, without having to carry the entire bag.

SUMMARY OF THE INVENTION

The object of the present invention is to avoid the above problems and to produce a bag, particularly but not exclusively a golf bag, which allows the user to easily and rapidly remove a small portion of the bag to carry a small number of clubs.

In order to achieve these objects, the subject of the invention is a bag, particularly but not exclusively a golf bag, characterized in that it comprises a main bag and a smaller carrying bag, capable of carrying approximately 1–5 clubs. When the two bags are joined, the resulting configuration is typical of a conventional golf bag. However, the user may easily detach the carrying bag and carry a small number of clubs to a remote area of the course without having to carry the entire bag. This allows the user to leave a majority of the bag and clubs in a particular place, such as the golf cart, while using a small portion of the overall bag to carry a small number of clubs to an area remote from the position of the main bag.

In the particular case of a golf bag, the accessories which complete the equipment of the bag are the conventional elements of a golf bag, such as, but not limited to, a carrying handle, the shoulder-strap, umbrella holder, ball holder, the rain hood (which can be fitted to cover the clubs and is in turn detachable from the assembly and can even be folded between the two club-carrying compartments and the accessory-carrying bag when it is not in use), any pockets formed on the outside of the club-carrying compartments for carrying items which are bulky and not bulky (score-cards, tees, markers, gloves, etc.).

Structurally, there are no limits to the type of material which can be used for the various components, in that the club-carrying compartments and the accessory-carrying bag can be made equally well with soft walls (artificial leather, leather; textile) or with rigid walls (laminated resin, plastics material; metal; cellulose compounds, etc.) The rigidity necessary for the stress points intended to support the loads or to provide the force required may be achieved by local reinforcement or reinforcement of the whole length. The general geometrical shape of the bag can vary.

Although the use of the bag according to the invention as a golf bag is particularly advantageous, different uses, such as a traveling bag or suitcase, can be considered just as convenient.

BRIEF DESCRIPTION OF THE DRAWINGS

The invention will now be described in detail with reference to the appended drawings, provided purely by way of non-limiting example, in which.

DETAILED DESCRIPTION OF THE INVENTION

Figure 2:
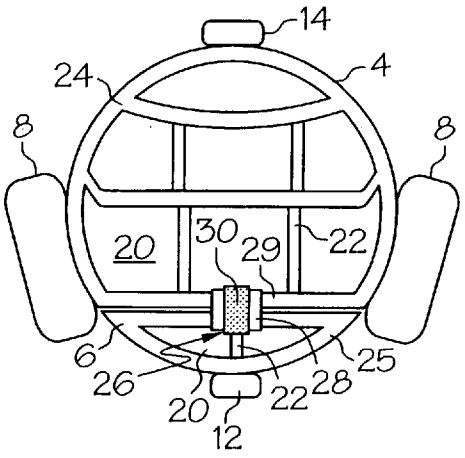
FIG. 2 is a top view of the bag.
Figure 1:
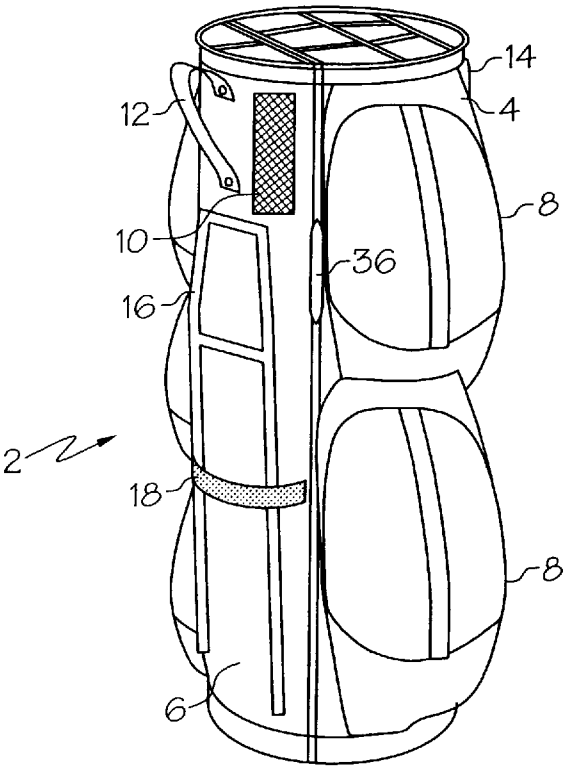
FIG. 1 is a perspective frontal view of a golf bag according to the invention.

With reference initially to FIGS. 1 and 2, a bag according to the invention is generally indicated 2 and can be used primarily as a golf bag for carrying golf clubs and golf accessories. The bag 2 comprises essentially a main bag 4 and a smaller carrying bag 6. The carrying bag 6 is detachable from the main bag 4, allowing the golfer to carry a small amount of clubs to a position on the golf course without removing the heavier and bulkier main bag 4 from the golf cart to which the bag is attached. It should be understood that the bag 2 does not necessarily have to used only with a golf cart. The present invention may be used in any situation in which the golfer wishes to carry a small amount of clubs to a specific position on the course without having to carry the entire weight and bulk of the golf bag.

The various features on golf bags, such as pockets, compartments and holders for golf accessories are well known in the art and may be incorporated in the bag 2. Such items shown in the figures are primarily illustrative. It should be understood that the present invention is not limited to only the accessory features shown. Other well known features for carrying accessories may be added without frustrating the detachable carrying bag construction.

FIG. 1 illustrates some of these features. In this particular embodiment, zippered side pockets 8 are positioned on the side of the main bag 4. FIG. 1 shows these pockets 8 on the side for easy access when the bag 2 is strapped onto a golf cart. Pockets of various sizes may be distributed on any portion of the main bag 4 or the carrying bag 6 where functionally feasible. Also shown is ball pocket 10 for easy access to additional balls and grab handles 12, 14 for carrying the carrying bag 6 and the main bag 4, respectively. A shoulder strap (not shown) may also be attached to the main bag 4 for easier toting of the bag 2.

Also illustrated is a gravity stand 16. In this particular embodiment, the stand 16 is attached to the carrying bag 6 and hinged at the top. This allows the golfer to prop up the carrying bag 6, or the entire bag 2 if the carrying bag 6 is still attached to the main bag 4, in a generally up-right position. This allows the golfer easier access to clubs and prevents the bag from getting soiled if it were placed on the ground. This particular stand 16 is a gravity stand. It is merely hinged with a limited arc allowing for an acute angle. A strap 18 is provided to hold the stand 16 place against the carrying bag 6 when it is not in use. It should be recognized that there are a wide variety of stands that are well known. Some stands are removable from the bag and some are permanently attached to the bag. Automatic stands are also popular. The present stand 16 can be replaced with an automatic stand. In such a case, the bottom of the carrying bag is outfitted with a trigger, such as a plate trigger or an arm trigger, which under the weight of the bag causes, through a leverage mechanism, the stand to spring outward to an acute angle to support the bag in a stand-up position on the ground. Otherwise, when the bag is not sitting on the ground, the stand is urged against the bag. The present invention is only limited to the incorporation of a stand which is functionally feasible and not to the stand shown in FIG. 1, which serves primarily for illustrative purposes.

FIG. 2 shows the top of the bag 2. As can be seen, both the main bag 4 and the carrying bag 6 have a golf club separator arrangement comprising a number of openings 20 to receive golf clubs. These openings 20 are defined by both the perimeter of the bags 24, 25 and separators 22. The separator arrangement and number of openings may be dictated by preference. Conventional arrangements are designed to provide separation of the clubs for easy access to a particular club. Some arrangements provide separators 22 that extend partially or completely down the length of the bag to prevent tangling of the grip ends of the clubs. Varied golf club separator arrangements are well known. The arrangement shown in the FIGS. should not be considered limiting as the illustrated arrangement may be altered according to preference. In the this particular illustrative arrangement the main bag 4 has a configuration of separators 22 allowing for seven openings 20, which the carrying bag 6 has one separator 22 allowing for two openings 20. FIG. 1 also shows that the separator arrangement has a shallow configuration. That being, the separators have limited length relative to the length of the bag 2. It should be understood that the length of the separators may be varied according to preference.

Figure 3:
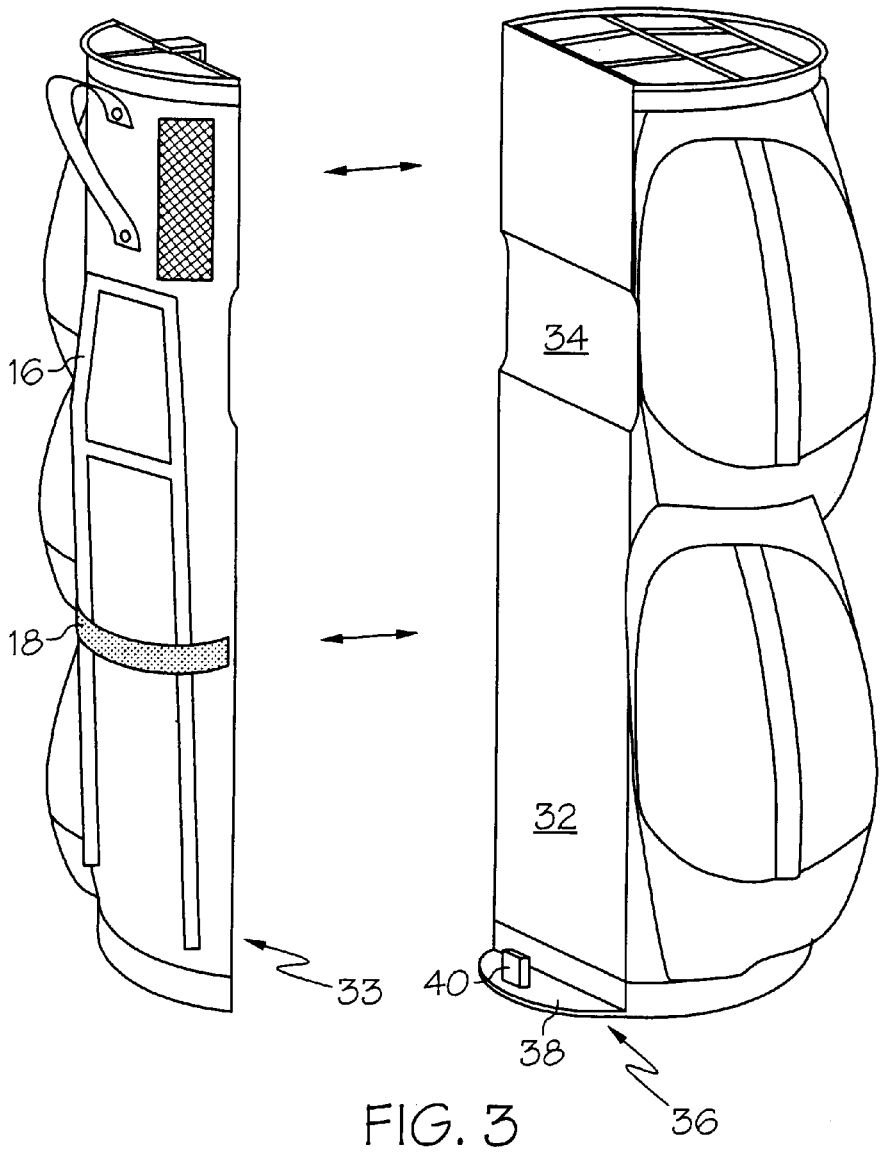
FIG. 3 is a perspective view which shows the carrying bag removed from the main bag.
Figure 7:
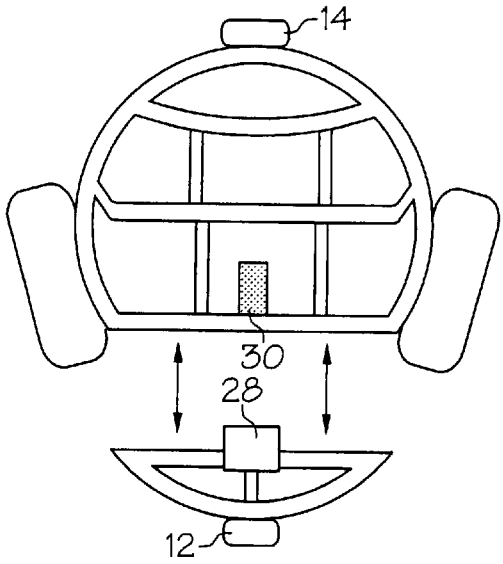
FIG. 7 is a top view of FIG. 3.

It should understood that the ability to easily remove the carrying bag 6 from the main bag 4 is the guiding focus of the present invention. The rapid/quick release mechanism/connection through which the carrying bag 6 is connected to, and removed from, the main bag 4 may vary provided that carrying bag 6 may be removed without inconvenience on the golf course. The separation of the carrying bag 6 and the main bag 4 is illustrated in FIGS. 3 and 7. As can be seen in these figures, the inner surface 32 of the main bag 4 is configured to give the impression that the portion which constitutes the carrying bag 6 is cut away from the bag 2. Inner surface 32 is relatively flat so as to mate relatively uniformly with the opposing relatively flat inner surface 33 of the carrying bag 6. It is preferred that the inner surfaces of the bags mirror each other so as to give the impression of a complete bag when they are coupled.

The inner surfaces 32, 33 preferably incorporate mirroring concave strips 34, 35. These strips provide a conduit 36 (as seen in FIG. 1) for the strap that holds the bag 2 on the golf cart. This allows the golfer to remove the carrying bag 6 without having to remove the strap which holds the bag 2 on the golf cart. With the carrying bag 6 removed, the main bag 4 stays secured to the golf cart.

FIG. 2 illustrates an attachment mechanism 26 which provides the connection between the top portion of the carrying bag 6 with the top portion of the main bag 4. The illustrated attachment mechanism 26 comprises a hook arrangement, wherein a hook 28 is attached to the carrying bag 6 and is arranged to extend over the edge or side 29 of the main bag 4. In this particular embodiment, the attachment mechanism 26 may also comprise a securement flap 30 which may be wrapped over the hook 28 to aid in holding it in place. The securement flap 30 may be a flexible loop and hook (VELCRO™) strap as shown in the figures. As such, the top of the hook 28 is preferably conditioned properly to receive the securement flap 30. Other attachment mechanisms may be employed including, but not limited to, a hinged hook, snaps, clip, clamp, latch, straps circumferential straps which wrap around the carrying bag 6 from the main bag 4 or some other quick release connection or coupler.

Figure 8:
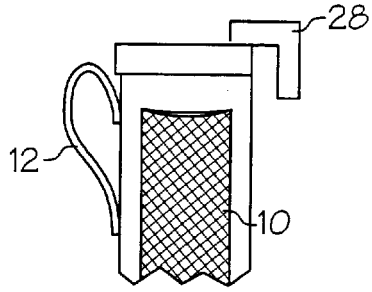
FIG. 8 is a side view of the top of the carrying bag.

FIGS. 7 and 8 further illustrate the hook and securement flap embodiment of the attachment mechanism 26. FIG. 7 shows the carrying bag 6 removed from the main bag 4. The hook 28 is attached to the carrying bag 6, a side view of which can be seen in FIG. 8, while the securement flap 30 is attached to the main bag 4. Flap 30 is attached far enough down inside of the main bag 4 so that the end of the hook 28 can be received over the edge 29 of the main bag 4. The flap 30 may then be brought up over the hook 28 holding it in place. The flap 30 may also originate on top of the edge 29 of the main bag 4, to the side of the hook 28, and be brought down across the hook 28 and secured to the edge 29 on the opposite side of the hook 28 from which the flap 30 originated.

Figure 4:
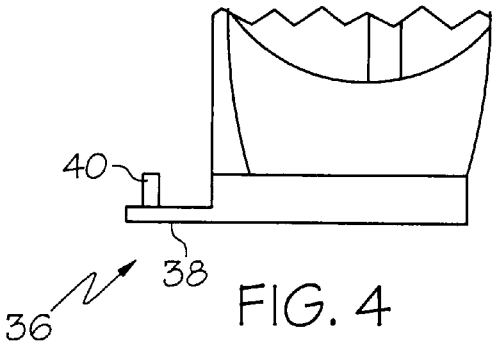
FIG. 4 is a side view of the bottom of the main bag.
Figure 5:
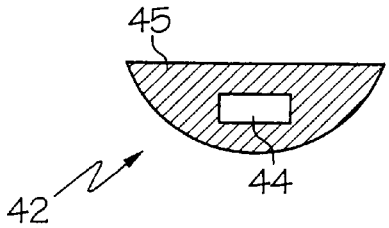
FIG. 5 is a bottom view of the carrying bag.

The quick release connection of the present embodiment also comprises a coupling/attachment mechanism between the bottom of the carrying bag 6 and the main bag 4. This coupling mechanism works in conjunction with the attachment mechanism 26 to secure the carrying bag 6 to the main bag 4. FIGS. 3–5 illustrate the coupling mechanism of this particular embodiment. As mentioned above, it should be understood that a wide variety of coupling mechanisms or attachment mechanisms may be employ as long as the carrying bag can be quickly removed from the main bag.

The coupling mechanism between the bottom of the bags demonstrated by FIGS. 3–5 is a basic mating arrangement which cooperates easily with the attachment mechanism 26.

This particular arrangement comprises a male post arrangement 36 which comprises a partial plate 38 and a post 40. FIG. 5 illustrates the female arrangement 42, which, in this embodiment, comprises a receptacle 44, in this case an opening 44 in the bottom 45 of the carrying bag 6, for receiving the post 40. In practice, in the present embodiment, the attachment mechanism 26 and the coupling mechanism are engaged relatively at the same time, cooperating together to secure the carrying bag 6 to the main bag 4.

Figure 6:
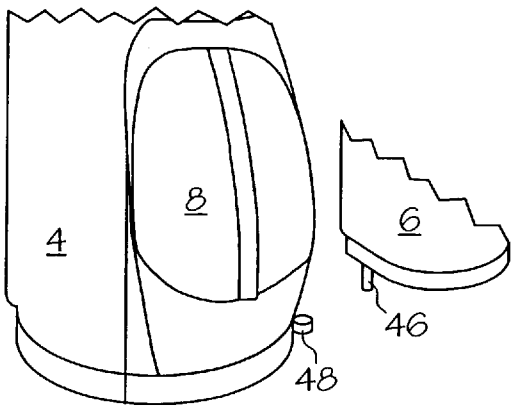
FIG. 6 is a perspective frontal view of the bottom of the bag showing an alternative embodiment of the attachment between the carrying bag and the main bag.

FIG. 6 illustrates an alternative embodiment of the coupling mechanism, wherein the mechanism is reversed. In this particular situation, the carrying bag 6 incorporates the post 46 and the main bag 4 incorporates the receptacle 48, which in this case is a loop.

Figure 9:
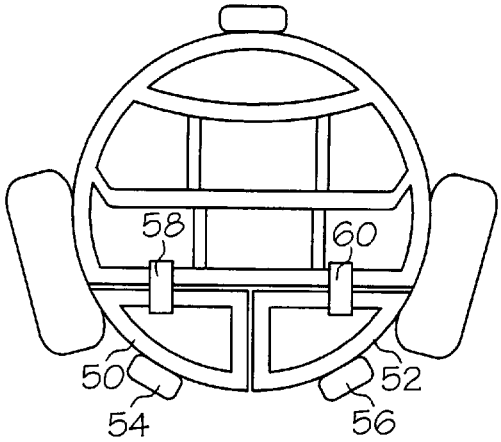
FIG. 9 is a top view of an alternative embodiment of the invention.
Figure 11:
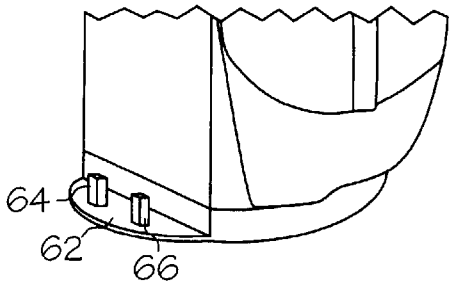
FIG. 11 is a side perspective view of the bottom of the main bag of the alternative embodiment of the invention.
Figure 10:
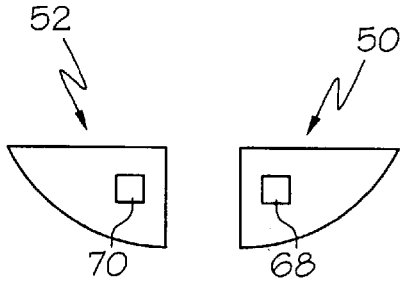
FIG. 10 is a bottom view of the dual carrying bags of the alternative embodiment of the invention.

FIGS. 9–11 illustrated an alternative embodiment of the invention. In this particular case, there are two carrying bags 50, 52, each having a separate bag handle 54, 56, rather than one carrying bag 6. For example, this allows the golfer to keep some wedges and a putter in one carrying bag permanently, leaving an extra carrying bag for other situations.

The quick release connection illustrated is essentially the same as shown in FIGS. 2–5 and 7–8. As mentioned above, the quick release connection may be embodied in a number of mechanisms as long as it provides for quick release of the carrying bags from the main bag. The attachment mechanisms 58, 60 shown in this embodiment of FIG. 9 are essentially the same as the attachment mechanism 26 shown in FIG. 2.

FIGS. 10–11 illustrate the coupling mechanism for the dual carrying bags, which is essentially the same as the one shown in FIGS. 3–5, differing in that there are two carrying bags instead of one. FIG. 11 shows apartial plate 62 cooperating with a pair of posts 64, 66 to receive the receptacle openings 68, 70 positioned on the bottom of carrying bags 50 and 52.

In general, the material used for the bags comprises those materials conventually used in making golf bags. Preferably, the inner sides 32, 33 are made of a rigid material for added support.

Furthermore, although specific reference has been made to the use of the bag according to the invention as a golf bag in the example illustrated, the same utility and advantages of the invention also extend to different uses of the bag, for example, to its use as a traveling bag or suitcase.

In addition to the specific embodiments claimed below, the invention is also directed to other embodiments having any other possible combination of the independent features claimed below in combination with the dependent features claimed below.

The disclosure is intended to be illustrative and not exhaustive. This description will suggest many variations and alternatives to one of ordinary skill in this art. All these alternatives and variations are intended to be included within the scope of the attached claims. Those familiar with the art may recognize other equivalents to the specific embodiments described herein which equivalents are also intended to be encompassed by the claims attached hereto.

We claim:

1. A golf bag of variable configuration comprising a main golf club carrying bag and a first smaller golf club carrying bag, the first smaller golf club carrying bag being detachably connected to the main bag by a first quick release mechanism, the smaller carrying bag having a length consistent with the length of the main bag, the golf bag further comprising a second smaller carrying bag having a quick release mechanism connecting it to the main bag, both of the quick release mechanisms comprising a first attachment mechanism and a second attachment mechanism, the first attachment mechanisms being associated with the top portion of the smaller carrying bags and the main bag, and the second attachment mechanisms being associated with the bottom portion of the smaller carrying bags and the main bag, the first attachment mechanisms connecting the top portion of the smaller carrying bags to the top potion of the main bag and the second attachment mechanisms connecting the bottom portion of the smaller carrying bags to the bottom portion of the main bag.

2. A bag according to claim 1, wherein the first attachment mechanisms comprise a hook attached to the smaller carrying bags, whereby the hooks may be coupled to the main bag to connect the top portion of the smaller carrying bags with the top portion of the main bag.

3. A bag according to claim 1, wherein the second attachment mechanisms comprise a post and receptacle configuration, the post being received by the receptacle to connect the bottom portion of the smaller carrying bags with the bottom portion of the main bag.

4. A bag according to claim 1, wherein the second attachment mechanisms comprise a post and receptacle configuration, the post being received by the receptacle to connect the bottom portion of the smaller carrying bags with the bottom portion of the main bag.

5. A golf bag of variable configuration comprising a main golf club carrying bag and a smaller golf club carrying bag, the smaller golf club carrying bag being detachably connected to the main bag, the detachable connection comprising a quick release mechanism comprising a first attachment mechanism and a second attachment mechanism, the first attachment mechanism being associated with the top portion of the smaller carrying bag and the main bag, and the second attachment mechanism being associated with the bottom portion of the smaller carrying bag and the main bag, the first attachment mechanism connecting the top portion of the smaller carrying bag to the top portion of the main bag and the second attachment mechanism connecting the bottom portion of the smaller carrying bag to the bottom portion of the main bag, wherein the second attachment mechanism comprises a post and receptacle configuration, the post being received by the receptacle to connect the bottom portion of the smaller carrying bag with the bottom portion of the main bag, the main bag further comprising a support plate extending radially from the bottom of the main bag, such that when the bags are coupled, the bottom of the smaller carrying bag is seated on the support plate.

6. A bag according to claim 5, wherein the first attachment mechanism comprises a hook attached to the smaller carrying bag, whereby the hook may be coupled to the main bag to connect the top portion of the smaller carrying bag with the top portion of the main bag.

7. A bag according to claim 5, wherein the post is positioned on the support plate and the receptacle is a hole in the bottom of the smaller carrying bag to receive the post.

8. A bag according to claim 6, wherein the post is positioned on the support plate and the receptacle is a hole in the bottom of the smaller carrying bag to receive the post.

9. A bag according to claim 8, wherein the support plate is shaped to match the bottom of the smaller carrying bag.

10. A bag according to claim 5, wherein, when the bags are coupled, a conduit is formed between the bags, the conduit being sized to receive a retaining strap from a golf cart.

11. A bag according to claim 8, wherein, when the bags are coupled, a conduit is formed between the bags, the conduit being sized to receive a retaining strap from a golf cart.

12. A bag according to claim 10, wherein the main bag has a substantially flat surface and the smaller carrying bag has a substantially flat surface, wherein, when the bags are coupled, the flat surfaces are flush with each other, the bag further comprising a transverse groove in one of the flat surfaces, said transverse groove forming the conduit.

13. A bag according to claim 11, wherein the main bag has a substantially flat surface and the smaller carrying bag has a substantially flat surface, wherein, when the bags are coupled, the fat surfaces are flush with each other, the bag further comprising a transverse groove in one of the flat surfaces, said transverse groove forming the conduit.

14. A bag according to claim 12, wherein the transverse groove is formed in the flat surface of the main bag.

15. A bag according to claim 13, wherein the transverse groove is formed in the flat surface of the main bag.

16. A bag according to claim 12, the flat surfaces of both bags having transverse grooves, wherein the transverse grooves mirror one another to form the conduit.

17. A bag according to claim 13, the flat surfaces of both bags having transverse grooves, wherein the transverse grooves mirror one another to form the conduit.

18. A bag according to claim 5, the smaller carrying bag having a length consistent with the length of the main bag.

* * * * *